United States Patent [19]

Remley

[11] 4,331,437

[45] May 25, 1982

[54] PROCESS FOR IMPARTING WRINKLE RESISTANCE TO CELLULOSIC TEXTILE MATERIALS AND MATERIALS OBTAINED THEREBY

[75] Inventor: Kenneth H. Remley, Warren, N.J.

[73] Assignee: American Cyanamid Co., Stamford, Conn.

[21] Appl. No.: 168,895

[22] Filed: Jul. 11, 1980

[51] Int. Cl.[3] ..... D06M 13/40; D06M 9/00

[52] U.S. Cl. ..... 8/115.7; 8/116 P; 8/192; 427/393.3; 427/337; 428/276

[58] Field of Search ..... 8/116 P, 192, 115.7; 427/393.3, 337; 428/276

[56] References Cited

U.S. PATENT DOCUMENTS 2,530,261 11/1950 Morton et al. ..... 8/116 P
3,892,906 7/1975 Swidler et al. ..... 427/333

FOREIGN PATENT DOCUMENTS 47-52000 12/1972 Japan ..... 8/116 P
1275739 5/1972 United Kingdom .

OTHER PUBLICATIONS

Jung et al., Amer. Dyestuff Rep., vol. 61, pp. 56, 58, 60–61, May 1972.

O'Brien, Textile Research Journal, Mar. 1968, pp. 263–264.

*Primary Examiner*—Maria Parrish Tungol
*Attorney, Agent, or Firm*—H. G. Jackson

[57] ABSTRACT

The invention is a process whereby a fibrous cellulosic textile material is rendered wrinkle resistant by impregnating the material with an aqueous mixture of urea and at least one phosphoric acid, wherein the mole ratio of urea to phosphoric acid is about 4:1 to 8:1, to deposit thereon about 7.0–35% by weight of urea, and about 3.0–9.0% by weight of the phosphoric acid, based on the weight of the untreated material; heating the treated material to obtain a phosphorylated material; contacting the phosphorylated material with an aqueous solution of cyanamide to deposit thereon about 0.75–13.5% by weight of cyanamide, based on the weight of the phosphorylated material; and, heating the treated material to impart wrinkle resistance thereto.

10 Claims, No Drawings

PROCESS FOR IMPARTING WRINKLE RESISTANCE TO CELLULOSIC TEXTILE MATERIALS AND MATERIALS OBTAINED THEREBY

This invention is a process for producing wrinkle-resistant cellulosic textile materials, and the materials obtained thereby.

Fibrous cellulosic textile materials, such as cotton cloth, have been rendered wrinkle resistant in the past by treatment with a cross-linking agent, particularly with compounds containing two, or more, N-methylol, or N-alkoxymetnyl, groups.

However, compounds containing N-methylol groups, or N-alkoxymethyl groups, have a disadvantage in that on curing by heating they give off formaldehyde fumes which create environmental problems. There is a need, therefore, for wrinkle-resistant finishes for fibrous cellulosic textile materials which do not contain groups that liberate formaldehyde on heating.

It is known that fibrous cellulosic textile materials can be impregnated with a solution of cyanamide and phosphoric acid in water, according to U.S. Pat. No. 2,530,261, to impart improved wrinkle resistance to the treated material. This phenomenon is also described by O'Brien in "Cyanamide-Based Durable Flame-Retardant Finish for Cotton," *Textile Research Journal,* March, 1968, pp 263–264. However, it has been found that pad baths of cyanamide and phosphoric acid are unstable, and the tensile strength losses incurred are high.

It is also known that wrinkle resistance can be imparted to fibrous cellulosic textile materials by treating said materials with an aqueous solution of a phosphonic acid and cyanamide, and further treating the material with a solution of cyanamide, as disclosed in U.S. Pat. No. 3,892,906. However, pad bath instability is also a problem in this system. Other disadvantages include the relatively high costs of the cyanamide and phosphoric acids.

The invention is a process whereby a fibrous cellulosic textile material is rendered wrinkle resistant by impregnating the material with an aqueous mixture of urea and at least one phosphoric acid, wherein the mole ratio of urea to phosphoric acid is about 4:1 to 8:1, to deposit thereon about 7.0–35% by weight of urea, and about 3.0–9.0% by weight of the phosphoric acid, based on the weight of the untreated material; heating the treated material to obtain a phosphorylated material; contacting the phosphorylated material with an aqueous solution of cyanamide to deposit thereon about 0.75–13.5% by weight of cyanamide, based on the weight of the phosphorylated material; and, heating the treated material to impart wrinkle resistance thereto.

In the preferred embodiment, the mole ratio of urea to the phosphoric acid is about 5:1 to 7:1, and the urea and phosphoric acid deposited on the fabric are 15–30%, and 5.0–8.0%, respectively; the aqueous solution of cyanamide contains about 1.0–8.0% by weight of cyanamide, and the cyanamide deposited on the phosphorylated material is about 0.7–6.5% by weight.

In accordance with the invention, there are also provided wrinkle-resistant fibrous cellulosic textile materials obtained by the process of the invention.

The invention affords the following advantages:

1. The solution applied and the finished fabric contain no formaldehyde.

2. The problem of pad bath instability, inherent in the cyanamide/phosphoric acid, and cyanamide/phosphonic acid systems, is eliminated.
3. The level of wrinkle resistance is greatly improved over that obtained by usage of a corresponding mixture of cyanamide and phosphoric acid.

DESCRIPTION OF PREFERRED EMBODIMENTS

In carrying out the process of the invention, a solution of a phosphoric acid and urea in water, hereafter referred to as "Solution A," is prepared, containing a mole ratio of urea to phosphoric acid of about 4/1–8/1, preferably about 5/1–7/1.

Solution A can be prepared by adding urea to an aqueous solution of orthophosphoric acid, for example, at ambient temperature to provide a reaction mixture containing about 3.8–13.0%, preferably about 5.0–10.5%, by weight of orthophosphoric acid, and about 9.0–50.0%, preferably about 20.0–40.0%, by weight of urea.

Suitable phosphoric acids which may be used include the following:

orthophosphoric acid,
pyrophosphoric acid,
metaphosphoric acid,
and mixtures thereof.

Solution A is applied to a cellulosic textile material by any of the conventional methods of application, such as padding, spraying, dipping, and the like. Suitable cellulosic textile materials include cotton, rayon, and linen fabrics, as well as blends of these materials with hydrophobic fibers such as polyesters, nylon, polyacrylates, and the like. The preferred fabric is 100% cotton.

In carrying out the invention, the textile material is passed through a pad bath of Solution A, and passed between squeeze rolls to remove excess solution and obtain a wet pick-up of about 70–80%, preferably about 74–76%, by weight of Solution A, based on the weight of the untreated textile material. The treated material is then dried at about 80°–120° C. for about 1–15 minutes, preferably at about 100°–110° C. for about 2–6 minutes. The dried fabric contains about 3.0–9.0%, preferably about 5.0–8.0%, by weight of the phosphoric acid, and about 7.0–35.0%, preferably about 15.0–30.0%, by weight of urea, based on the weight of the dried material. After drying, the treated material is cured at about 140°–190° C. for about 1–6 minutes, preferably at about 160°–175° C. for about 1–4 minutes.

Preferably, Solution A also contains about 0.1% by weight of a surfactant which may be cationic, anionic, or nonionic. Preferably, the surfactant is nonionic.

Illustrative examples of suitable surfactants include the following:

nonylphenol-ethylene oxide polyether alcohols,
trimethylnonyl polyethylene glycol ether,
octylphenoxy polyethoxy ethanol,
isooctylphenoxy polyethoxy ethanol, and the
dihexyl ester of sodium sulfosuccinic acid.

The preferred surfactant is trimethylnonyl polyethylene glycol ether.

Solution B is prepared by adding cyanamide to water at ambient temperature to provide a solution containing about 2.0–17.0%, preferably about 3.0–8.0%, by weight of cyanamide.

The cured phosphorylated material is then rinsed with water and dried by conventional methods, preferably by frame drying, and treated with Solution B in the manner described above. The expression is such that wet pickup of Solution B is about 60–80%, preferably about 65–75%, by weight, based on the weight of the phosphorylated material. The treated material is dried, in the manner described above, to provide a material containing about 0.75–13.5%, preferably about 1.2–6.0% by weight of cyanamide, based on the weight of the dried material. After drying, the treated material is cured at about 140°–190° C. for about 1–6 minutes, preferably at about 160°–175° C. for about 1–4 minutes.

The following examples illustrate the process of the present invention. All parts are by weight unless otherwise indicated.

EXAMPLES 1 AND 2

A pad-bath solution is prepared containing 16.5% by weight of urea and 6.7% by weight of orthophosphoric acid in water to provide an application solution containing 4 moles of urea per mole of phosphoric acid.

A second pad-bath solution is prepared containing 24.7% by weight of urea and 6.7% by weight of orthophosphoric acid in water to provide an application solution containing 6 moles of urea per mole of phosphoric acid.

The solutions of the above pad baths are applied to 100% cotton broadcloth by padding, two dips and two nips, to obtain wet pickups of 77.3% and 79.8%, respectively, based on the weight of the untreated fabric. The treated fabrics are dried for 3 minutes at 107° C., and cured for 3 minutes at 171° C. The fabrics are then rinsed in water at 25° C. and dried for 3 minutes at 107° C. The fabric treated with the first pad-bath solution is labeled Fabric A and the one treated with the second pad-bath solution is labeled Fabric B.

A pad-bath solution, containing 3.75% by weight of cyanamide in water, is prepared and applied to Fabrics A and B by padding to obtain wet pickups of 66.6% and 68.7%, respectively, based on the weights of Fabrics A and B. The treated fabrics are then dried for 3 minutes at 107° C., and cured for one minute at 171° C.

The treated and untreated fabrics are tested for wrinkle recovery (American Association of Textile Chemists and Colorists Test Method 166–1975), and fill tensile strength (American Society for Testing Materials Test Method D-1682-64/R 1970).

The results obtained are shown below:

| Example | Fabric | Wrinkle Recovery (degrees) | Tensile Strength (lbs) |
|---|---|---|---|
| 1 | A | 254 | 28 |
| 2 | B | 257 | 26 |
| | Untreated | 146 | 47 |

EXAMPLES 3 AND 4

Pad-bath solutions are prepared in the manner of Examples 1 and 2, respectively, except that 3.75% by weight of real cyanamide is added to each solution. The solutions of the above pad baths are applied to 100% cotton broadcloth by padding to obtain wet pickups of 79.4% and 77.9%, respectively, based on the weight of the untreated fabric. The treated fabrics, A and B, respectively, are then dried for 3 minutes at 107° C., and cured for 3 minutes at 171° C. The treated fabric is then process washed with a 0.1% solution of soap and 1% soda ash, and dried.

The results obtained are shown below:

| Example | Fabric | Wrinkle Recovery (degrees) | Tensile Strength (lbs) |
|---|---|---|---|
| 3 | A | 220 | 34 |
| 4 | B | 202 | 35 |
| | Untreated | 146 | 47 |

Comparison of the above results with the results of Examples 1 and 2 shows that the process of the present invention gives superior wrinkle recovery than the corresponding process wherein the phosphoric acid, urea, and cyanamide are all applied in one bath.

EXAMPLE 5

A pad-bath solution is prepared, containing 3.75% by weight of cyanamide, and 6.7% by weight of orthophosphoric acid in water, and applied to 100% cotton broadcloth by padding to obtain a wet pickup of 75.4%, based on the weight of the untreated material. The treated fabric is then drid for 3 minutes at 107° C., and cured for one minute at 149° C. The treated fabric is then process washed with a 1% solution of soap and 1% soda ash, and dried.

The results obtained are shown below:

| Example | Wrinkle Recovery (degrees) | Tensile Strength (lbs) |
|---|---|---|
| 5 | 222 | 29 |
| Untreated | 146 | 47 |

The above results, obtained by the conventional application of a mixture of cyanamid and phosphoric acid, show that the wrinkle recovery imparted by the application is inferior to that obtained by the process of the invention illustrated by Examples 1 and 2.

EXAMPLES 6 AND 7

Separate pad-bath solutions are prepared containing 21.5% by weight of urea and 6.0% by weight of othophosphoric acid in water to provide application solutions containing 5.85 moles of urea per mole of phosphoric acid.

The solutions of the above pad baths are applied to 100% cotton broadcloth by padding, two dips and two nips, to obtain wet pickups of 80.7 and 80.5%, respectively, based on the weight of the untreated fabric. The treated fabrics are dried for one and one-half minutes at 107° C. and cured for one minute at 171° C. The fabrics are then rinsed with water and dried at 107° C. for one and one-half minutes.

The fabric treated with the first pab-bath solution is labeled "Fabric A" and the one treated with the second pad-bath solution is labeled "Fabric B."

Pad-bath solutions, containing 1.0% and 0.5% by weight, respectively, of cyanamide in water, are applied to Fabrics A and B, respectively, by padding to obtain wet pickups of 77.3% and 79.1%, respectively, based on the weights of Fabrics A and B. The treated fabrics are then dried for one and one-half minutes at 107° C., and cured for one minute at 171° C.

The wrinkle recovery and tensile strength results obtained are shown below:

| Example | Fabric | Wrinkle Recovery (degrees) | Tensile Strength (lbs) |
|---|---|---|---|
| 6 | A | 268 | 19 |
| 7 | B | 236 | 20 |
| | Untreated | 186 | 31 |

The above results illustrate the process of the present invention wherein the amounts of cyanamide deposited on the fabric are 0.8% and 0.4%, respectively.

I claim:

1. A process for imparting wrinkle resistance to a fibrous cellulosic textile material comprising:

(a) contacting the material with an aqueous mixture of urea and at least one phosphoric acid, wherein the mole ratio of urea to the phosphoric acid is about 4:1 to 8:1, to deposit thereon about 7.0–35% by weight of urea, and about 3.0–9.0% by weight of the phosphoric acid, based on the weight of the untreated material;

(b) heating the treated material to obtain a phosphorylated material;

(c) contacting the phosphorylated material with an aqueous solution of cyanamide to deposit thereon about 0.75–13.5% by weight of cyanamide, based on the weight of the phosphorylated material; and (d) heating the treated material to impart wrinkle resistance thereto.

2. The process according to claim 1 wherein (a) the material is contacted with an aqueous mixture of urea and the phosphoric acid, wherein the mole ratio of urea to the phosphoric acid is about 5:1 to 7:1, to deposit thereon about 15–30% by weight of urea, and about 5.0–8.0% by weight of the phosphoric acid, (c) the phosphorylated material is contacted with an aqueous solution of cyanamide to deposit thereon about 2.5–6.0% by weight of cyanamide.

3. The process according to claim 1 wherein the phosphoric acid is orthophosphoric acid.

4. The process according to claim 1 wherein the fibrous cellulosic textile material is 100% cotton cloth.

5. The process according to claim 1 wherein the fibrous cellulosic textile material is a blend of at least 50% polyester and cotton.

6. The wrinkle resistant textile materials obtained according to the process of claim 1.

7. The wrinkle resistant textile materials obtained according to the process of claim 2.

8. The wrinkle resistant textile materials obtained according to the process of claim 3.

9. The wrinkle resistant textile materials obtained according to the process of claim 4.

10. The wrinkle resistant textile materials obtained according to the process of claim 5.

* * * * *